US007165861B2

(12) United States Patent
Wickart

(10) Patent No.: US 7,165,861 B2
(45) Date of Patent: Jan. 23, 2007

(54) ULTRAVIOLET PEG ILLUMINATION

(75) Inventor: Mark Wickart, Lisle, IL (US)

(73) Assignee: DuPage Children's Museum, Naperville, IL (US)

( * ) Notice: Subject to any disclaimer, the term of this patent is extended or adjusted under 35 U.S.C. 154(b) by 196 days.

(21) Appl. No.: 10/954,412

(22) Filed: Sep. 30, 2004

(65) Prior Publication Data

US 2006/0067075 A1 Mar. 30, 2006

(51) Int. Cl.
*F21V 33/00* (2006.01)

(52) U.S. Cl. ..... 362/154; 362/84

(58) Field of Classification Search ..... 362/249, 362/604, 84

See application file for complete search history.

(56) References Cited

U.S. PATENT DOCUMENTS 2,837,836 A * 6/1958 Morawitz ..... 273/282.1
5,069,458 A * 12/1991 Washington ..... 273/238
5,121,926 A * 6/1992 Pfaender ..... 273/236
6,032,393 A * 3/2000 Maxim ..... 40/548

* cited by examiner

*Primary Examiner*—Ali Alavi
(74) *Attorney, Agent, or Firm*—Carmen B. Patti & Assoc., LLC

(57) ABSTRACT

One or more panels of an apparatus in one example comprise a plurality of receptacles for a plurality of pegs. One or more ultraviolet lights illuminate the plurality of pegs.

21 Claims, 5 Drawing Sheets

ULTRAVIOLET PEG ILLUMINATION

TECHNICAL FIELD

The invention relates generally to a toy or game device and more particularly to a toy or game device involving light transmitting pegs.

BACKGROUND

Existing toy illuminating devices, such as Lite Brite® (Hasbro, Inc., Pawtucket, R.I.), employ a perforated screen or peg board that receives colored plastic pegs. An opaque mask, such as black paper, is placed over the perforated screen. A user inserts a colored plastic peg into the perforated screen, puncturing the black paper with the colored plastic peg. A light source behind the perforated screen shines light through the perforations of the black paper and illuminates the colored plastic pegs, which creates a colored light design on the opposite side of the perforated screen, as is known in the art.

The colored plastic pegs used in the existing toy illuminating devices are of a relatively small size that presents a choking hazard for young children. The colored plastic pegs are also easily lost or broken. The black paper is a consumable item, often used for only one colored light design and then discarded. In a high usage environment, for example, a public museum, cost of the black paper substantially increases a cost of operation of the toy illuminating device. Existing toy illuminating devices also lack visibility from multiple angles. A user must stand on an opposing side to the light source in order to view the colored light design.

Thus, a need exists for a toy illuminating device that is large enough to provide a museum-quality immersion experience that will withstand the rigors of a very high traffic environment; allow child and adult to work on the unit together physically; and have pegs that are not a choke hazard. A further need exists for a toy illuminating device that is re-usable with a reduced number of consumables.

SUMMARY

The invention in one implementation encompasses an apparatus. The apparatus comprises one or more panels and one or more ultraviolet lights. The one or more panels comprise a plurality of receptacles for a plurality of pegs. The one or more ultraviolet lights illuminate the plurality of pegs.

DESCRIPTION OF THE DRAWINGS

Features of exemplary implementations of the invention will become apparent from the description, the claims, and the accompanying drawings in which:

DETAILED DESCRIPTION

Figure 1:
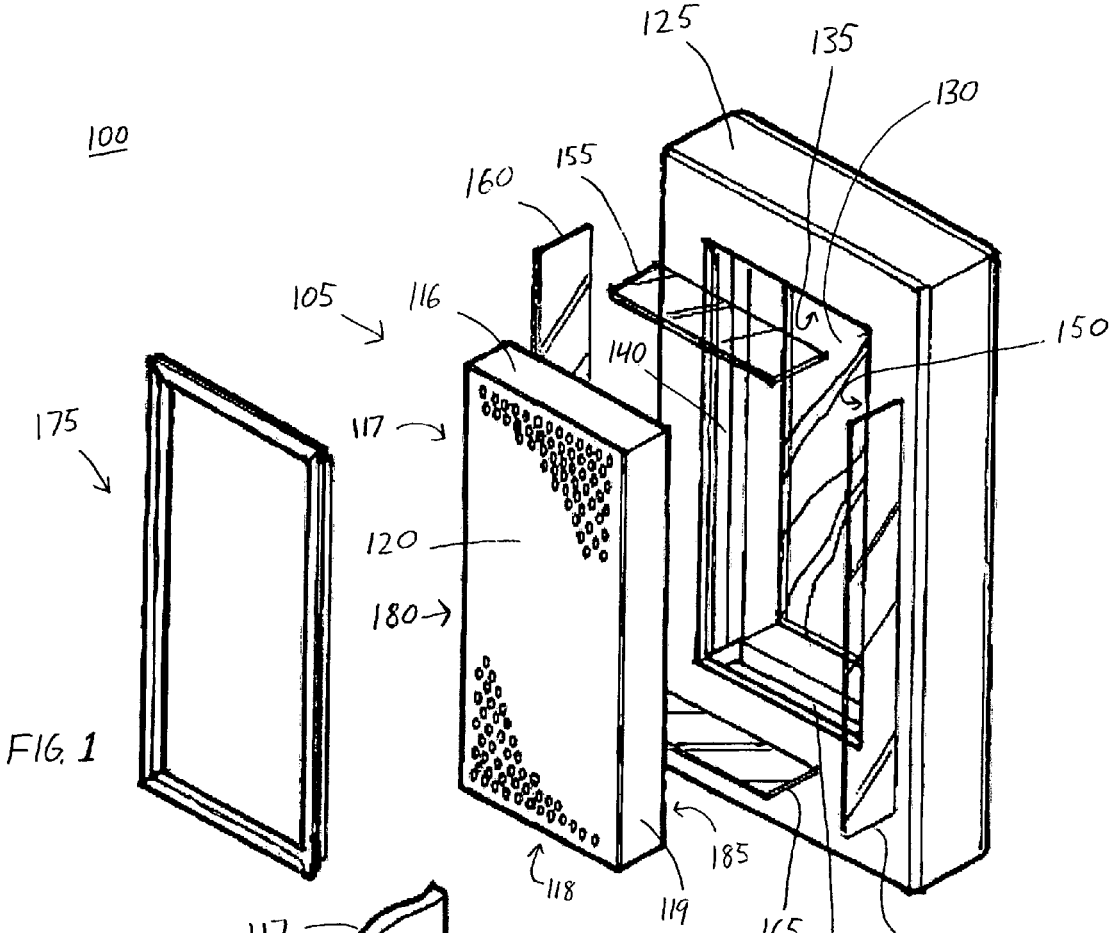
FIG. 1 is an exploded, perspective representation of one exemplary implementation of an apparatus that comprises one or more panels, one or more sides, one or more screens, one or more enclosure panels, one or more light receptacles, one or more light transmission mediums, one or more ultraviolet transmission portions, and one or more frames.

Turning to FIGS. 1–5, an apparatus 100 in one example comprises one or more panels 105. The panel 105 in one example comprises one or more sides 116, 117, 118, and 119, and one or more screens 120. The panel 105 in one example comprises Sintra® (Alcan Composites, USA Inc., St. Louis, Mo.). The sides 116, 117, 118, and/or 119 in one example comprise plexiglass, plastic, or glass. The screen 120 in one example comprises a perforated sheet of Sintra®. In another example, the screen 120 comprises an opaque or translucent material such as tinted glass, plastic, or black colored Sintra®. The sides 116, 117, 118, and 119 and the screen 120 in one example are fused together with PVC glue.

The panel 105 in one example is located within one or more enclosure panels 125. The enclosure panel 125 in one example comprises one or more light transmission mediums 130, one or more light receptacles 135, 140, 145, and 150, and one or more ultraviolet lights 305, 310, 315, and 320. In one example, the light transmission medium 130 comprises Plexiglas. In another example, the light transmission medium 130 comprises glass. One or more panes of glass 155, 160, 165, and 170 in one example are substantially located between the one or more sides 116, 117, 118, and/or 119 and the one or more light receptacles 135, 140, 145, and/or 150 within the enclosure panel 125. The panel 105 in one example comprises one or more frames 175. The frame 175 in one example outlines the panel 105.

The panel 105 in one example comprises one or more interactable sides 180 and one or more viewable sides 185. The interactable side 180 in one example is substantially parallel to the viewable side 185. The panel 105 in one example receives one or more of a plurality of pegs 210 from the interactable side 180. The ultraviolet lights 305, 310, 315, and/or 320, for example, "black lights," shine through the ultraviolet transmission portions 155, 160, 165, and/or 170 to illuminate the plurality of pegs 210. The one or more of the plurality of pegs 210 are viewable from the viewable side 185 of the panel 105.

Figure 2:
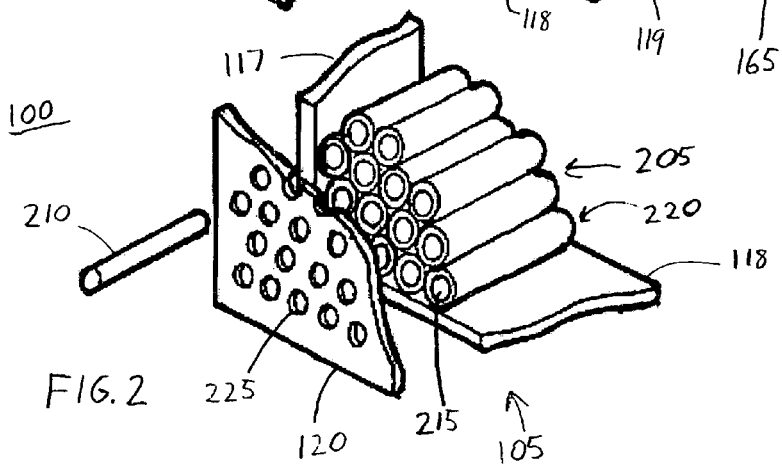
FIG. 2 is a cutaway, partial, sectional, enlarged, perspective representation of the screens, the sides, one or more receptacles for one or more pegs and one or more apertures of the one or more receptacles of the panels of the apparatus of FIG. 1.
Figure 3:
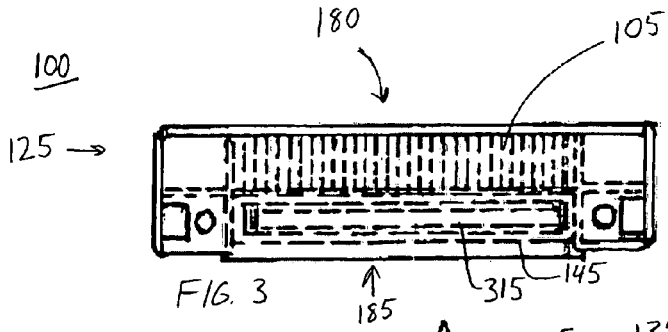
FIG. 3 is a top-view representation of the panel of the apparatus of FIG. 1.
Figure 4:
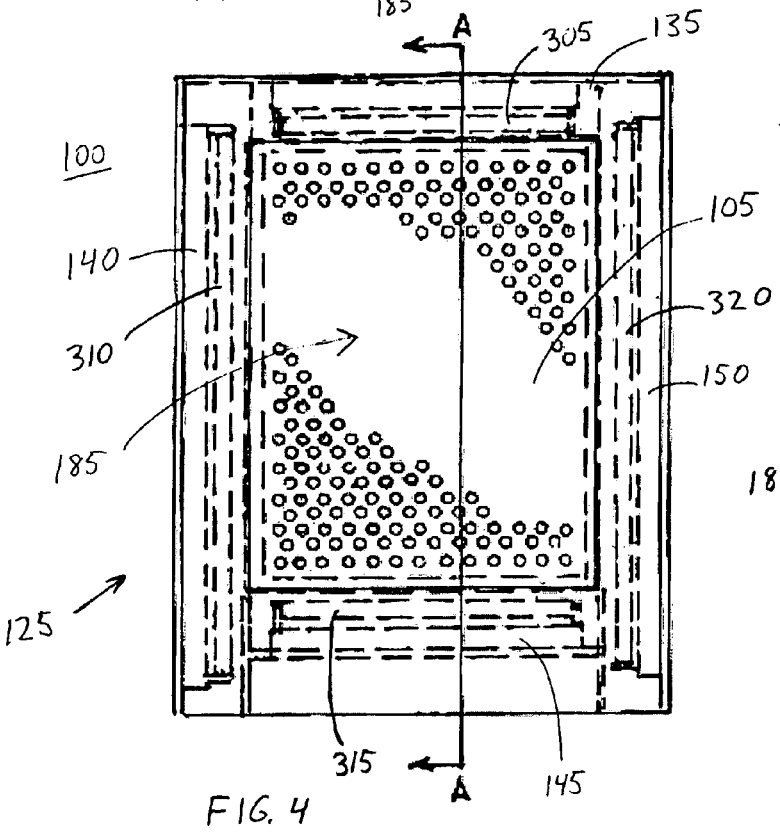
FIG. 4 is a side-view representation of the panel of the apparatus of FIG. 1.
Figure 5:
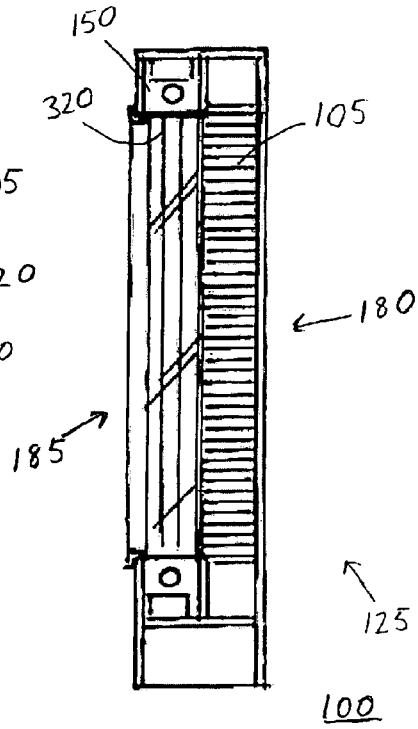
FIG. 5 is another side-view representation of the panel of the apparatus of FIG. 1.

Referring to FIG. 2, the panel 105 in one example comprises a plurality of receptacles 205 for a plurality of pegs 210. The receptacle 205 comprises one or more PVC tubing segments. The peg 210 in one example comprises ultraviolet reactive acrylic rod. In one example, the receptacle 205 comprises a tubular shape. In another example, the receptacle 205 comprises a rectangular shape. In one example, the receptacles 205 comprise a honeycomb pattern. In another example, the receptacles 205 comprise a grid-like pattern. The peg 210 in one example comprises a shape substantially similar to the receptacle 205, for example, a cylinder or a tubular shape. The plurality of receptacles 205 in one example are positioned in orthogonal relationships to the one or more interactable sides 180 and the one or more viewable sides 185. The receptacle 205 in one example comprises a first aperture 215 and a second aperture 220. The first aperture 215 in one example abuts the interactable side 180 of the panel 105. The second aperture 220 in one example abuts the viewable side 185 of the panel 105. The peg 210 in one example is inserted into the first aperture 215. The peg 210 is viewed from the second aperture 220. The light transmission medium 130 in one example prevents the peg 210 from falling through the second aperture 220.

The screen 120 in one example comprises one or more apertures 225. The apertures 225 in one example comprise a shape substantially similar to the first apertures 215. The apertures 225 of the screen 120 are positioned over the apertures 215 of the receptacle 205 to allow for insertion of the peg 210 through the aperture 225 and into the aperture 215. The screen 120 in one example serves as a matrix or frame to contrast the "glow" of the pegs. The ultraviolet rays are transmitted through the sides of the exposed peg.

Figure 6:
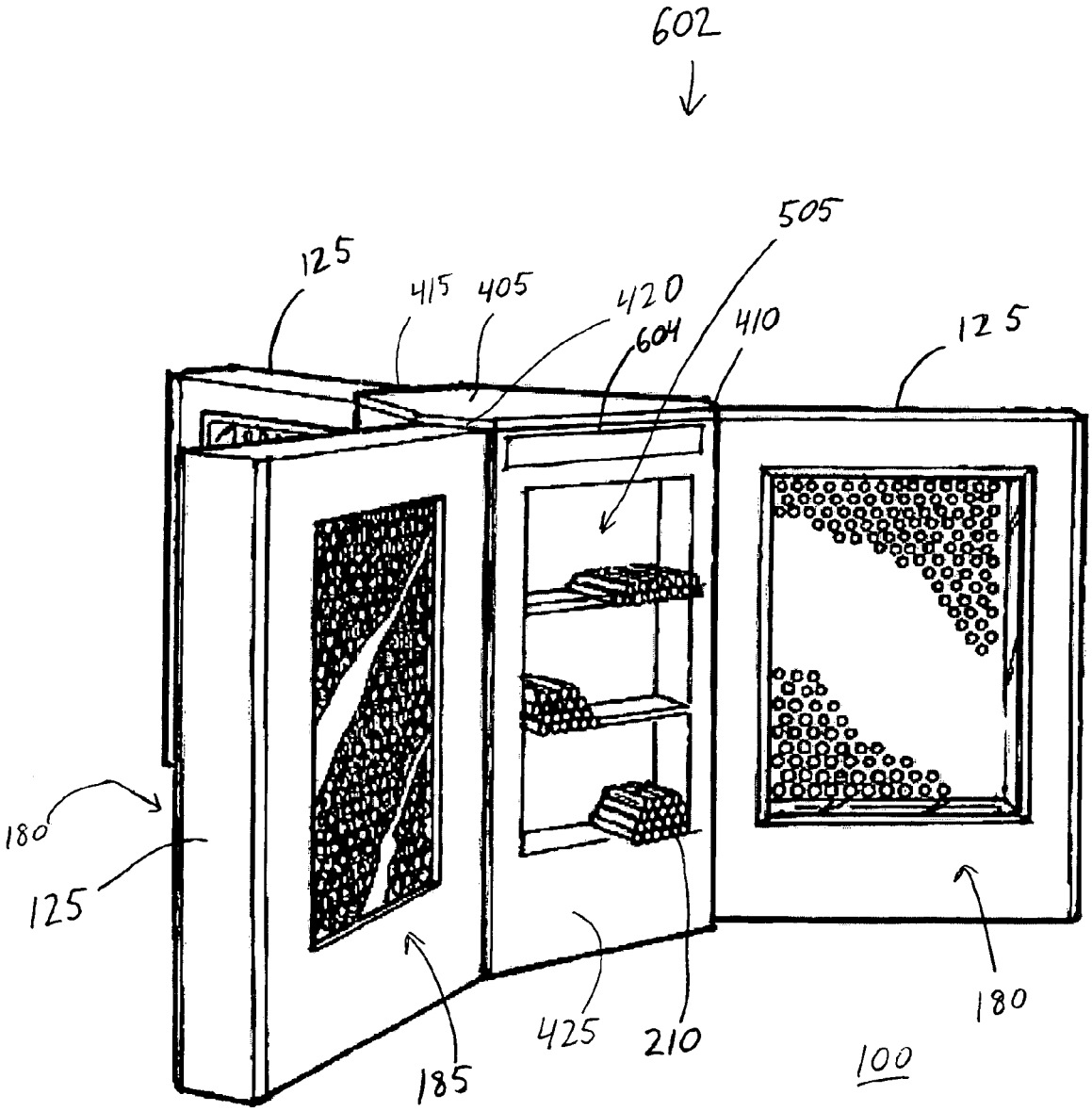
FIG. 6 is a perspective representation of one exemplary configuration of the panels of the apparatus of FIG. 1 connected to one or more connection sides of a center base.
Figure 7:
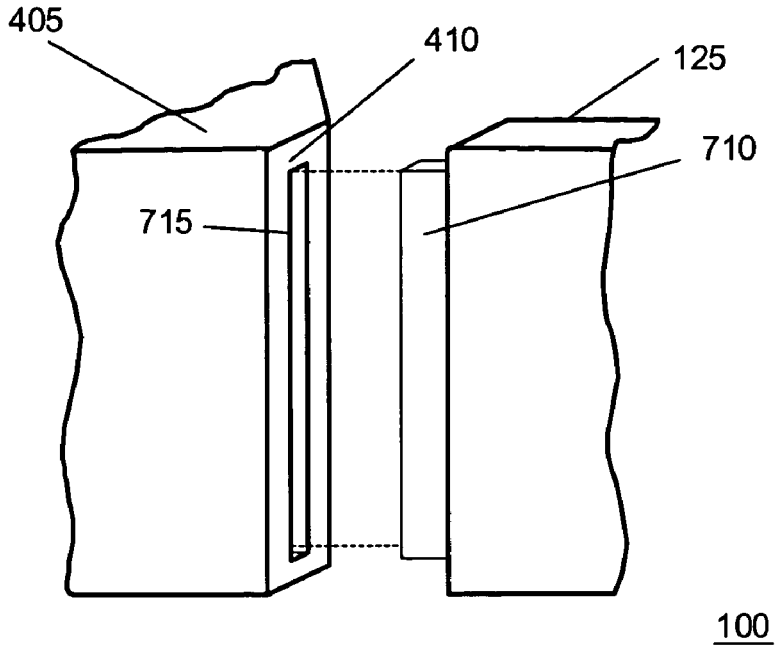
FIG. 7 is a perspective, exploded representation of the connection side of the center base and the enclosure panel of the apparatus of FIG. 6.
Figure 8:
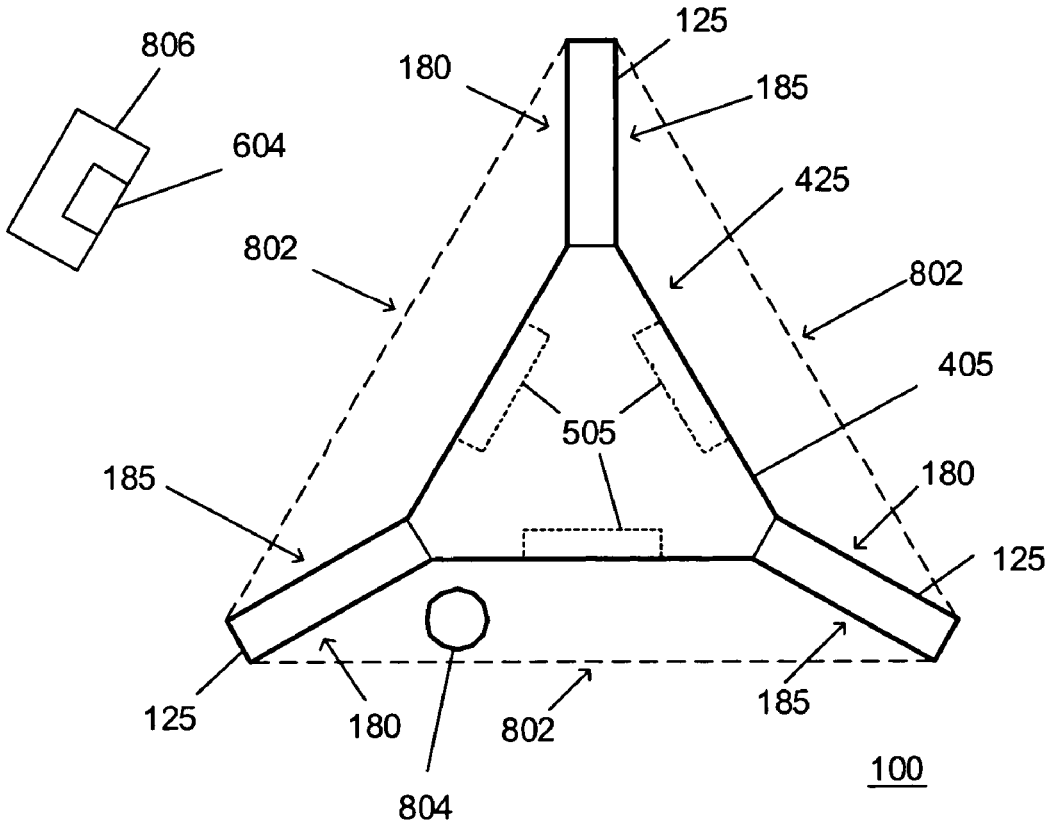
FIG. 8 is a top-view representation of the exemplary configuration of the panels of the apparatus of FIG. 6.

Turning to FIGS. 6–8, an exemplary configuration 602 comprises a center base 405 that connects to one or more enclosure panels 125. The center base 405 in one example comprises one or more connection sides 410, 415, and 420, and one or more storage sides 425. In a further example, the center base 405 comprises one or more ultraviolet lights 604. The enclosure panels 125 connect to the one or more connection sides 405, 410, and/or 415. The storage sides 425 in one example comprise one or more storage receptacles 505. The one or more storage receptacles 505 serve to store unused pegs. In one example, the center base 405 connects in the configuration 602 to three enclosure panels 125. Other configurations, for example, four, five, or more panels 125 connected to one or more center bases 405 are possible, as will be appreciated by those skilled in the art.

The connection sides 410, 415, and 420 and the enclosure panels 125 in one example comprise complementary engagement portions that serve to connect the one or more enclosure panels 125 to the center base 405. In one example, the enclosure panels 125 comprises one or more inserts 710 and the connection sides 410, 415, and 420 comprise one or more slots 715. For example, an enclosure panel 125 is connected to the center base 405 by sliding the insert 710 into the slot 715, as will be appreciated by those skilled in the art.

The configuration 602 in one example comprises a plurality of safety zones 802 for one or more users 804 to occupy. For example, the panels 125 and center base 405 form a plurality of partial enclosures that shield the user 804. The user 804 in one example places pegs 210 in the interactable side 180 of a first panel 125 to create a design with the pegs 210, while observing a design of another user 804 in the viewable side 185 of an opposing second panel 125, as will be appreciated by those skilled in the art.

The ultraviolet lights 604 of the center base 405 illuminate the pegs 210 that are in the storage receptacles 505. In another example, one or more of the ultraviolet lights 604 face outwards to illuminate the pegs 210 that are outside of the panel 125 and outside of the storage receptacle 505, for example, pegs 210 that are in the hand of the user 804. In yet another example, one or more ultraviolet lights 604 are located externally to the center base 405. For example, the ultraviolet lights 604 are mounted in a ceiling fixture or external enclosure 806. In one example, light from the ultraviolet lights 305, 310, 315, 320, and 604 is directed and/or partially blocked such that the pegs 210 are only illuminated when placed in the panel 125, placed in the storage receptacle 505, or approximately located within the safety zone 802, for example, to encourage a young user 802 to keep the pegs 210 near the center base 405 and the panel 125, as will be appreciated by those skilled in the art.

Where the configuration 602 is located in a public setting, for example, a children's museum, the safety zone 802 promotes protection of the user 804, for example, a young child, from other children that may be running around nearby. The safety zone 802 also promotes a focused attention of the user 804 by partially blocking off other distractions from peripheral vision of the user 804. The safety zone 802 can be made deeper, for example, more enclosed, by increasing the number of panels 125 per center base 405, as will be appreciated by those skilled in the art.

Figure 9:
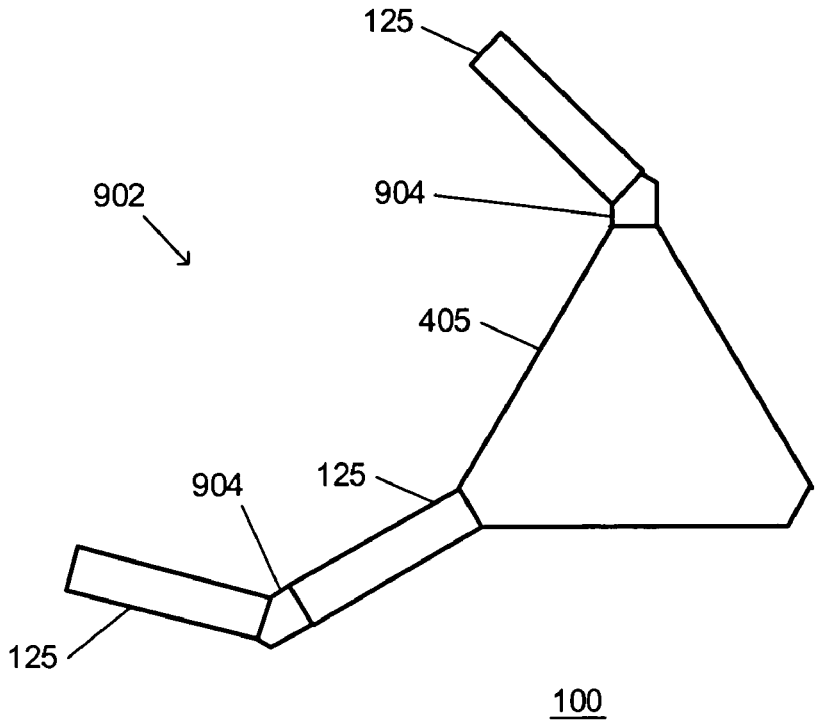
FIG. 9 is a top-view representation of another exemplary configuration of the panels and center base of FIG. 6 and a connector component.
Figure 10:
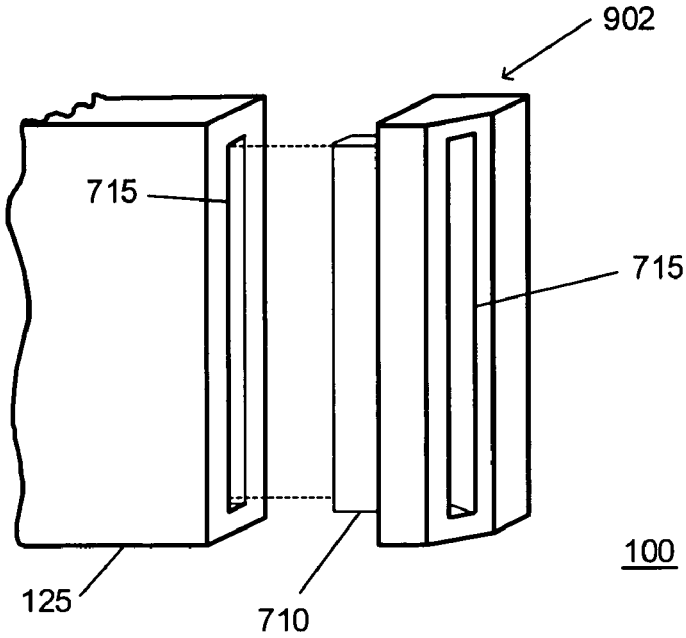
FIG. 10 is a perspective, exploded representation of the panel and the connector component of the apparatus of FIG. 9.

Turning to FIGS. 9–10, a configuration 902 in one example comprises one or more panels 125 and a center base 405 joined by one or more connector components 904. The connector component 904 in one example comprises an insert 710 and a slot 715 that are at an angle to each other, for example, forty-five degrees. The insert 710 of the connector component 904 can be inserted into the slot 715 of the center base 405, a slot 715 of a panel 125, or the slot 715 of another connector component 904. The slot 715 of the connector component 904 can receive an insert 710 of the panel 125 or another connector component 904. The safety zone 802 can be made deeper by inserting one or more connector components 904 between the panels 125 and/or the center base 405 to change an angle of the panels 125 to the center base 405, as will be appreciated by those skilled in the art.

The apparatus 100 in one example comprises a plurality of components such as one or more of electronic components and hardware components. A number of such components can be combined or divided in the apparatus 100. The apparatus 100 in one example comprises any (e.g., horizontal, oblique, or vertical) orientation, with the description and figures herein illustrating one exemplary orientation of the apparatus 100, for explanatory purposes.

The steps or operations described herein are just exemplary. There may be many variations to these steps or operations without departing from the spirit of the invention. For instance, the steps may be performed in a differing order, or steps may be added, deleted, or modified.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. An apparatus, comprising:

one or more panels that comprise a plurality of receptacles for a plurality of pegs; and one or more ultraviolet lights that illuminate the plurality of pegs;

wherein the one or more panels comprise one or more interactable sides and one or more viewable sides; and wherein one or more of the plurality of pegs are inserted into one or more of the plurality of receptacles from the one or more interactable sides; and wherein the one or more of the plurality of pegs are viewable from the one or more viewable sides; and wherein the one or more interactable sides are substantially parallel to the one or more viewable sides, and wherein the plurality of receptacles are positioned in orthogonal relationships to the one or more interactable sides and the one or more viewable sides.

2. The apparatus of claim 1, wherein the plurality of receptacles comprise one or more first apertures and one or more second apertures, and wherein the one or more first apertures abut the one or more interactable sides, and wherein the one or more second apertures abut the one or more viewable sides; and wherein the one or more of the plurality of pegs are inserted into one or more of the one or more first apertures; and wherein the one or more of the plurality of pegs are viewed through one or more of the one or more second apertures.

3. The apparatus of claim 2, wherein the one or more interactable sides comprise one or more screens, wherein the one or more screens comprise one or more third apertures;

wherein the one or more third apertures are positioned over the one or more first apertures to allow for insertion of the one or more of the plurality of pegs into the one or more first apertures.

4. The apparatus of claim 3, wherein the one or more screens serve to block light from the one or more ultraviolet lights.

5. The apparatus of claim 1, further comprising one or more enclosure panels;

wherein the one or more enclosure panels comprise one or more light transmission mediums, and wherein the plurality of pegs are viewable through the one or more light transmission mediums.

6. The apparatus of claim 5, wherein the one or more light transmission mediums comprises Plexiglas.

7. The apparatus of claim 6, wherein the one or more light transmission mediums comprises glass.

8. The apparatus of claim 1, wherein the plurality of receptacles for the plurality of pegs comprise a honeycomb pattern.

9. The apparatus of claim 1, wherein the plurality of receptacles comprise PVC tubing.

10. The apparatus of claim 1, wherein the plurality of pegs comprise ultraviolet reactive acrylic rods.

11. An apparatus, comprising:

one or more panels that comprise a plurality of receptacles for a plurality of pegs; and one or more ultraviolet lights that illuminate the plurality of pegs;

wherein the one or more panels comprise one or more sides, and wherein the one or more panels are located within one or more enclosure portions; and wherein the one or more ultraviolet lights that illuminate the plurality of pegs shine through the one or more sides onto the plurality of receptacles for the plurality of pegs.

12. The apparatus of claim 11, wherein the one or more ultraviolet lights are located within the one or more panels;

wherein one or more light transmission portions are located between the one or more ultraviolet lights and the one or more sides;

wherein the one or more ultraviolet lights that illuminate the plurality of pegs shine through the one or more light transmission portions.

13. The apparatus of claim 12, wherein the one or more light transmission portions comprise glass;

wherein the light transmission portions allow light to pass through one or more viewable sides of the one or more panels;

wherein the light transmission portions prevent the plurality of pegs from falling through a plurality of apertures of the plurality of receptacles.

14. The apparatus of claim 11, wherein the one or more panels comprise one or more frames that outline the one or more panels.

15. An apparatus, comprising:

one or more panels that comprise a plurality of receptacles for a plurality of pegs; and one or more ultriviolet lights that illuminate the plurality of pegs;

wherein the one or more panels are located within one or more enclosure portions, and wherein the plurality of pegs comprise one or more used pegs and one or more unused pegs, the apparatus further comprising:

a center base that comprises one or more connection sides and one or more storage sides;

wherein the one or more enclosure portions engage the one or more connection sides to connect to the center base; and wherein the one or more storage sides comprise one or more storage receptacles for the one or more unused pegs.

16. The apparatus of claim 15, wherein the one or more connection sides and the one or more enclosure portions comprise complementary engagement portions that serve to connect the one or more enclosure portions to the center base.

17. The apparatus of claim 15, wherein the one or more enclosure portions and the center base form one or more safety zones for a user to interact with and/or view the one or more panels.

18. The apparatus of claim 17, wherein one or more of the one or more ultraviolet lights illuminate the one or more pegs only when the one or more pegs are:

inserted in the one or more panels;

located in the one or more storage receptacles; and/or located approximately within the one or more safety zones.

19. The apparatus of claim 15, wherein the one or more panels comprise one or more frames that outline the one or more panels.

20. The apparatus of claim 15, wherein the plurality of receptacles for the plurality of pegs comprise a honeycomb pattern.

21. The apparatus of claim 15, wherein the plurality of receptacles comprise PVC tubing.

* * * * *